US005607149A

United States Patent [19]

van Nimwegen et al.

[11] Patent Number: 5,607,149

[45] Date of Patent: Mar. 4, 1997

[54] APPARATUS FOR COVERING THE MOUNTING MECHANISM OF A BASKETBALL GOAL

[75] Inventors: Edward G. van Nimwegen, North Ogden; Jared G. Sahleen, Pleasant View, both of Utah

[73] Assignee: Lifetime Products, Inc., Clearfield, Utah

[21] Appl. No.: 502,822

[22] Filed: Jul. 14, 1995

[51] Int. Cl.[6] ..... A63B 63/08

[52] U.S. Cl. ..... 473/479

[58] Field of Search ..... 273/1.5 R, 1.5 A

[56] References Cited

U.S. PATENT DOCUMENTS

| | | | |
|---|---|---|---|
| 4,438,923 | 3/1984 | Engle et al. | 273/1.5 R |
| 4,441,709 | 4/1984 | Schroeder et al. | 273/1.5 R |
| 4,534,556 | 8/1985 | Estlund et al. | 273/1.5 R |
| 4,575,079 | 3/1986 | De Faveri | 273/1.5 R |
| 4,676,503 | 6/1987 | Mahoney et al. | 273/1.5 R |
| 4,846,469 | 7/1989 | Nye | 273/1.5 R |
| 5,106,084 | 4/1992 | Vaught | 273/1.5 R |

OTHER PUBLICATIONS

Basketball Survey Center, Easy–Adjuster Adjustable Basketball Pole Owners Manual, Jan. 1989.

Wilson Adjustable Backstop Support, Backboard And Goal Kit Assembly Instructions, Mar. 1990.

Photographs, "Pro Slam" rim, Part No. 7888 by Huffy Corporation (date unknown).

*Primary Examiner*—Paul E. Shapiro

*Attorney, Agent, or Firm*—Madson & Metcalf

[57] ABSTRACT

A cover for use on a basketball goal system. The cover includes a face plate which is configured with a channel for receiving the tip of a force-applying implement and is further configured to extend generally over the goal mounting mechanism of the goal such that the face plate provides a protective shield over the goal mounting mechanism when mounted to a goal. The face plate includes a pair of holes through which rim braces may extend when the cover is attached to a basketball goal for use in mounting the cover to the goal.

25 Claims, 5 Drawing Sheets

APPARATUS FOR COVERING THE MOUNTING MECHANISM OF A BASKETBALL GOAL

BACKGROUND

1. The Field of the Invention

The present invention is related to a cover that provides a protective shield for a goal mounting mechanism of a basketball goal system. More particularly, the present invention is related to a cover for a goal mounting mechanism which includes a face plate configured with a channel for receiving the tip of a force-applying implement, thereby facilitating the adjustment of the height of the goal system.

2. Technical Background

In recent years, basketball goal systems which allow the height of the basketball goal to be easily adjusted have been developed. One such system utilizes a deformable parallelogrammatic structure comprising upper and lower support members pivotally mounted at one end to a vertically disposed rigid support, such as pole or a wall, and at the other end to a mounting plate upon which a basketball backboard is usually mounted. The basketball goal is raised by applying an upward force with a long rod or similar force-applying implement underneath the horizontal plate of the goal.

Typically, these adjustable basketball systems are equipped with a breakaway rim. Breakaway rims are designed to dissipate the substantial downward force applied to the rim when the basketball is "slam dunked." Slam dunking involves throwing the basketball through the basketball goal from a position above the rim of the goal. The downward force results when a player strikes the rim with the basketball or with his arms, or when the player momentarily hangs from the rim after releasing the basketball in order to regain balance.

Such rims allow the goal to retractably break away from the backboard while absorbing a substantial amount of the energy imparted on the goal from the impact of the dunking force. One such breakaway rim, such as that disclosed in U.S. Pat. No. 4,846,469, utilizes two springs, each secured about a bolt such that the force of the springs holds the basketball goal in a horizontal position by forcing the mounting plate of the goal against the backboard or other rigid support member. Thus, when a threshold force is applied to the basketball goal and against the biasing force of the springs, the springs are compressed and the mounting plate breaks away from its resting position.

It will be appreciated that forces of great magnitude are applied to the goal mounting mechanism when the goal is in the breakaway position. As a result, should the mounting mechanism fail while the goal is in the breakaway position, elements of the mounting mechanism could become detached and projected through the air. Consequently, covers which fit over the goal mounting mechanism have been developed.

While many cover designs provide a protective barrier between the mounting mechanism and the player, they suffer from a variety of disadvantages. For example, many breakaway rims are used in connection with adjustable basketball goal systems. Such systems are generally adjusted by using a force-applying implement, such as a rod, to apply an upward force to the goal system. One convenient location for applying that force is on the basketball goal. However, many prior-art cover designs cover that area of the goal, thereby making it more difficult to securely engage the goal with a force-applying implement.

One proposed solution has been to utilize an adapter which fits over the end of the rod or pole and is configured to engage the rim. If no such adapter is readily available, the user may attempt to engage the goal system with the rod at a location which is not well suited for receiving the tip of the rod. This can result in the rod slipping out of engagement with the goal, thereby imparting excessive forces to the goal adjustment mechanism.

Another disadvantage to many cover designs is that they are often designed to only accommodate a particular manufacturer's goal and cannot be retrofit onto a standard basketball goal. Thus, a consumer must purchase the entire goal assembly in order to obtain a goal with a goal cover.

Also, many goal covers are expensive to manufacture, resulting in high prices to consumers.

From the foregoing, it will be appreciated that it would be an advancement in the art to provide an improved cover for use on a basketball goal which provides a protective shield over the goal mounting mechanism when mounted to a goal.

It would be a further advancement in the art to provide such a cover which does not have to be removed in order to safely raise or lower the height of a conventional adjustable basketball goal system.

It would be an additional advancement in the art to provide such a cover which could be retrofit onto a standard basketball goal system and which could be easily and inexpensively manufactured, thereby enabling the cover to be provided for sale to consumers at a low cost.

Such a device is disclosed and claimed herein.

BRIEF SUMMARY AND OBJECTS OF THE INVENTION

The present invention is directed to a novel device which provides a protective shield over the goal mounting mechanism of a basketball goal system. More particularly, the present invention relates to a cover for use on a basketball goal system which permits the goal system to be safely adjusted without removing the cover or using pole adapters to engage the rim.

In one embodiment, the cover comprises a face plate, a back plate and a top plate. The face plate extends generally over the goal mounting mechanism such that it provides a protective shield over the goal mounting mechanism when it is mounted to a goal.

The face plate is secured to the basketball goal by a pair of holes which accommodate the rim braces which pass through the cover. Each hole has a corresponding access channel which extends generally from the hole to the perimeter of the face plate and allows the introduction of the rim braces into the holes during the installation of the cover.

Because the access channels are narrower than the rim braces and the holes, the cover is made of a flexible material so that the access channels may be widened by twisting the face plate of the cover, thereby facilitating the installation of the rim braces into the holes.

The face plate is also configured with a notch for receiving the tip of a force-applying implement. The notch is preferably configured in the fore edge of the face plate such that the basketball rim and the notch act in combination to form a pocket which keeps the force-applying implement from slipping while the goal system is adjusted to the desired height.

The face plate is flexibly connected to a back plate. The back plate is configured with holes which correspond in size and position to a standard bolt pattern of a rim mounting plate of a basketball goal. When the cover is attached to the goal, the bolts used to mount the basketball goal pass through the back plate thus securing the cover to the basketball goal mounting system.

The back plate is flexibly connected to a top plate. The top plate extends generally over the horizontal rim plate of the goal. The top plate is attached to the horizontal rim plate of the goal by a pair of clips which engage the horizontal rim plate when the cover is mounted to a goal. The top plate of the cover is also configured with a pair of side plates which form a triangular shape. These side plates partially overlap with the face plate which is configured with flanges which extend around the edge of the side plates when the cover is mounted to a goal.

Thus, it is an object of the present invention to provide an improved cover for a basketball goal mounting mechanism.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
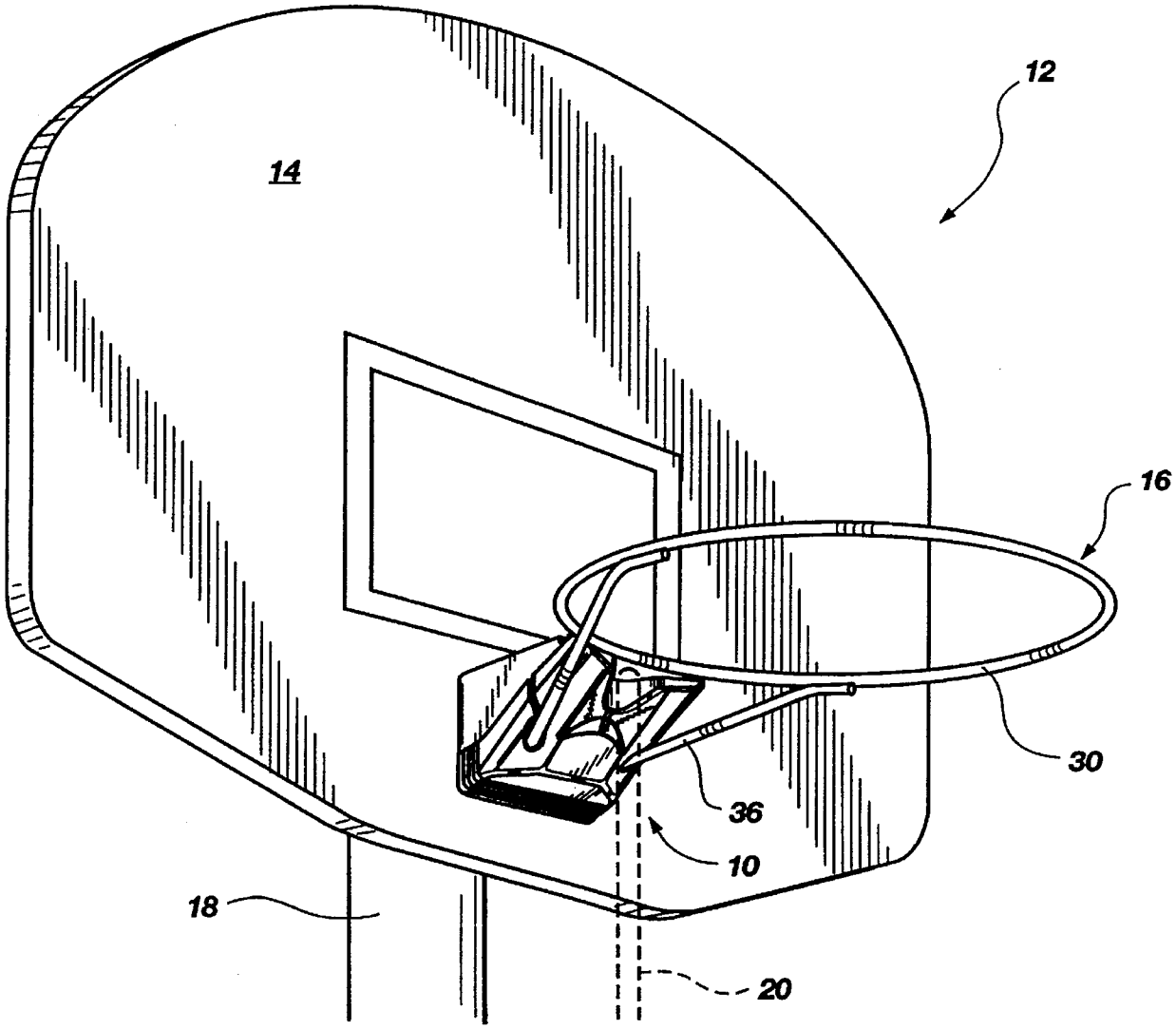
FIG. 1 is a perspective view of one preferred embodiment of the present invention mounted to a basketball goal system.

Reference is now made to the figures wherein like parts are referred to by like numerals throughout. With particular reference to FIG. 1, one preferred embodiment of the present invention is illustrated generally at 10. The cover 10 is mounted to a basketball goal system 12. The basketball goal system includes a backboard 14 and basketball goal 16. The goal 16 is mounted to the backboard 14 by a goal mounting mechanism (not shown in FIG. 1), as discussed in further detail below. The basketball goal system 12 will also often include a pole 18 and an adjustment mechanism (not shown) for adjusting the vertical disposition of the goal 16 relative to the playing surface. Typical of such adjustment mechanisms are those disclosed in U.S. Pat. Nos. 4,781,375 and 4,805,904 which are adjusted by using a force-applying implement 20 such as a pole or a rod.

Figure 2:
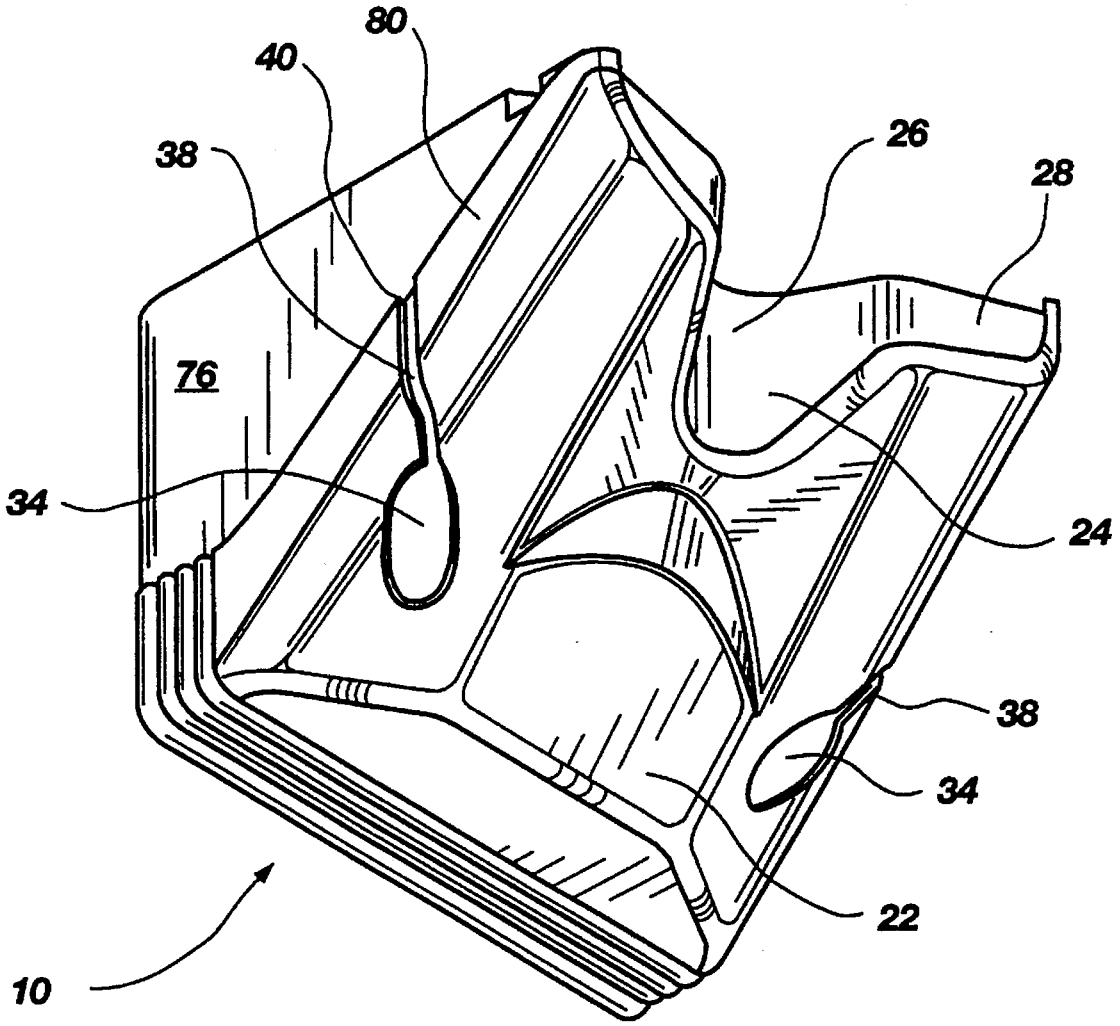
FIG. 2 is a close-up perspective view of the cover of FIG. 1.

With reference now to FIGS. 1 and 2, the cover 10 of the present invention comprises a face plate 22 configured with a channel 24 for receiving the tip of the force-applying implement 20. The face plate 22 is further configured to extend generally over the goal mounting mechanism such that the face plate provides a protective shield over the goal mounting mechanism when mounted to a goal 16.

In this preferred embodiment, the channel 24 comprises a notch 26 which is configured in the fore edge 28 of the face plate 22 such that when the cover 10 is mounted to a goal 16, the rim 30 of the goal acts in combination with the notch 26 to form a pocket for receiving the tip of the force-applying implement 20.

The cover 10 also includes attachment means for securing the cover 10 to the basketball goal 16. In this preferred embodiment, the attachment means comprises a pair of holes 34 positioned in the face plate 22 through which rim braces 36 may extend when the cover 10 is attached to a basketball goal 16.

The face plate 22 further comprises an access channel 38 corresponding to each hole 34 in the face plate. Each access channel 38 extends from its respective hole 34 to the edge 40 of the cover 10, thereby accommodating the introduction of a rim brace 36 into the hole 34 during installation of the cover 10 to a basketball goal assembly 12. The width of each access channel 38 is substantially narrower that the diameter of the rim braces 36 such that when the cover 10 is mounted to the goal 16 the rim braces 36 are positioned snugly within the holes 34 to keep the face plate 22 of the cover firmly in position. To permit installation, the face plate 22 is made of a flexible material such as a plastic. In this preferred embodiment, the entire cover 10 is made of polyethylene.

Figure 3:
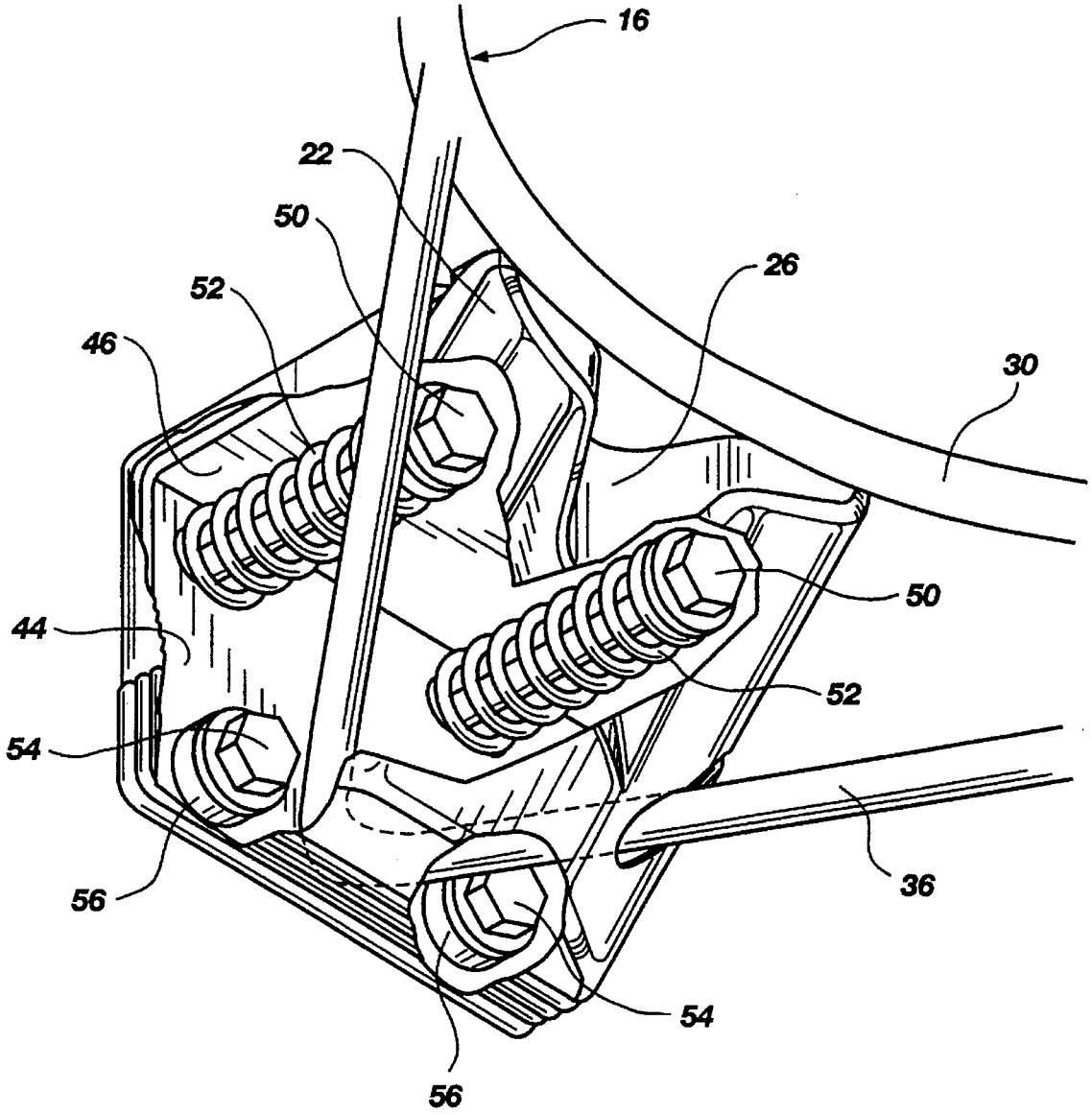
FIG. 3 is a close-up perspective view of the cover of FIG. 1 with portions broken away to illustrate the disposition of various components used to mount the basketball goal to a conventional backboard.

With reference now to FIG. 3, it can be seen that the goal 16 also includes a rim mounting plate 44 and a horizontal rim plate 46. Thus, when a rod or other force-applying implement 20 (FIG. 1) is introduced into the notch 26, the rod contacts the horizontal rim plate 46. If sufficient upward force is applied to the horizontal rim plate 46 with the rod, the goal system can be adjusted to the desired height without removing the cover 10.

One skilled in the art will appreciate that the particular shape of the notch 26 is not critical to the teachings of the present invention. For example, the notch could take the form of a V-shape, a square, a circle, or any other suitable shape which would permit engagement with a force-applying implement. Likewise, the position of the pocket is not crucial to the invention. The pocket could be placed anywhere in the face plate so long as it provides an adequate support for the force-applying implement.

The goal 16 is attached to the backboard by securing the rim mounting plate 44 to the backboard by any of a variety of methods known to those of ordinary skill in the art. In this embodiment of the present invention, the goal 16 is attached to the backboard 14 (FIG. 1) with a goal mounting mechanism which permits the goal 16 to break away when a predetermined force is applied to the goal. This embodiment of the goal mounting mechanism includes a pair of upper bolts 50 and a spring 52 associated with each upper bolt 50.

A pair of lower bolts 54 secure the lower portion of the rim mounting plate 44 to the backboard. A resilient ring 56, such as a rubber grommet, is associated with each lower bolt 54 to allow the lower bolts 54 to have a degree of flexibility as the goal pivots to a breakaway position.

As previously explained, the face plate 22 is configured to extend generally over the goal mounting mechanism such that the face plate 22 provides a protective shield over the goal mounting mechanism when mounted to a goal 16. In this embodiment which is specifically designed for use in connection with a goal mounting mechanism which permits the goal 16 to deflect to a break-away position, the face plate 22 extends over the upper bolts 50 and the lower bolts 54.

As will be appreciated by one of skill in the art, when the goal is in a break-away position with the springs 52 compressed, a substantial force is imposed on the upper bolts 50. Should one of the upper bolts 50 fail and the head of the bolt break off, the spring force would act directly on the head of the bolt possibly projecting it through the air. Thus, the cover 10 prevents any loose parts of the spring mounting mechanism from being propelled through the air or otherwise falling away from the area of the goal mounting mechanism.

Figure 4:
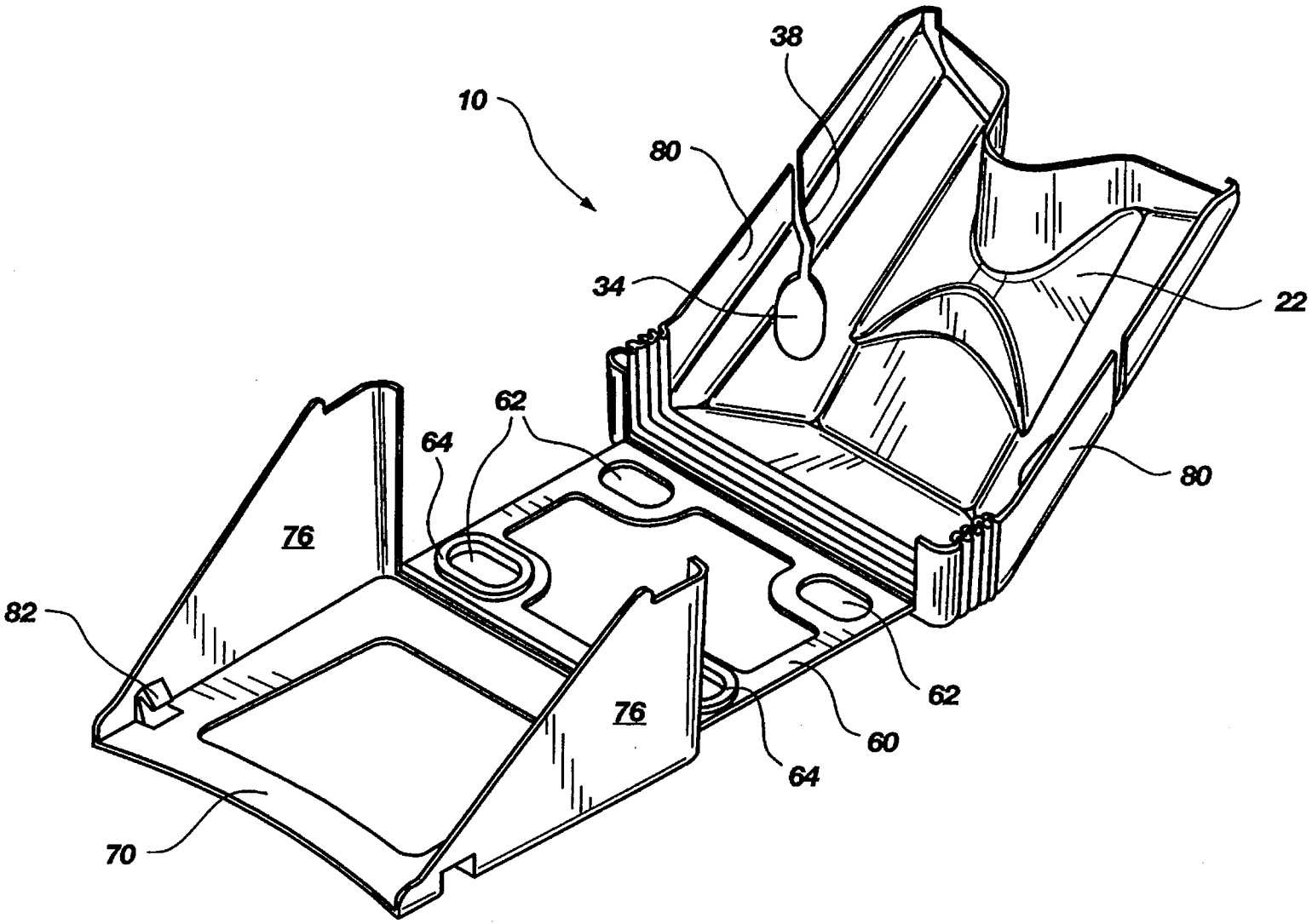
FIG. 4 is a perspective view of one presently preferred embodiment of the present invention prior to installation.

As illustrated in FIG. 4, the cover 10 of the present invention preferably is configured as a unitary molded piece of plastic. In this preferred embodiment, the cover 10 is made out of polyurethane and is formed through injection molding. Thus, the cover 10 can be easily and inexpensively manufactured, thereby allowing the cover to be available for purchase by consumers at a relatively low price.

With continued reference to FIG. 4, the cover 10 further comprises a back plate 60 which is flexibly connected to the face plate 22 via a "living hinge," as is known in the art of injection molding. The back plate 60 includes a plurality of holes 62 by which the back plate may be mounted to the goal 16. Thus, the means for attaching the cover 10 to the basketball goal system further includes the holes 62. Advantageously, the holes 62 are configured to correspond to the standard four-hole bolt pattern utilized in many conventional basketball goals. The holes 62 in the back plate 60 are elongated so that the cover of the present invention may be used with several variations of four-hole bolt patterns. Thus, the cover 10 of the present invention may easily be retrofit for use on a conventional basketball goal system. In this preferred embodiment, spacers 64 are configured around the holes 62 which correspond in position to the upper bolts 50.

With continued reference to FIG. 4, the cover 10 of the present invention further includes a top plate 70 which is flexibly connected to the back plate 60 via a "living hinge". The top plate 70 is sized to fit generally over the horizontal rim plate 46 (FIG. 3) when mounted to the goal.

Extending off the sides of the top plate 70 are side plates 76. As best seen by comparing FIGS. 2 and 3, the side plates 76 extend to cover the sides of the goal mounting mechanism. This function is further accomplished by configuring the face plate 22 with flanges 80. When mounted to a goal, the side plates 76 extend below the edges of the flanges 80. Thus, the flanges 80 and the side plates 76 partially overlap such that the goal mounting mechanism is completely enclosed by the cover 10.

As illustrated in FIG. 4, the top plate 70 is configured with a pair of clips 82. The clips 82 are configured such that they may engage the horizontal rim plate 46 (FIG. 3) and secure the top plate 70 firmly against the horizontal rim plate 46. Advantageously, when the rim is moved to a break-away position, the clips slidably engage the horizontal rim plate to allow for any relative movement between the top plate 70 of the cover and the horizontal rim plate 46 of the goal 16.

Figure 5:
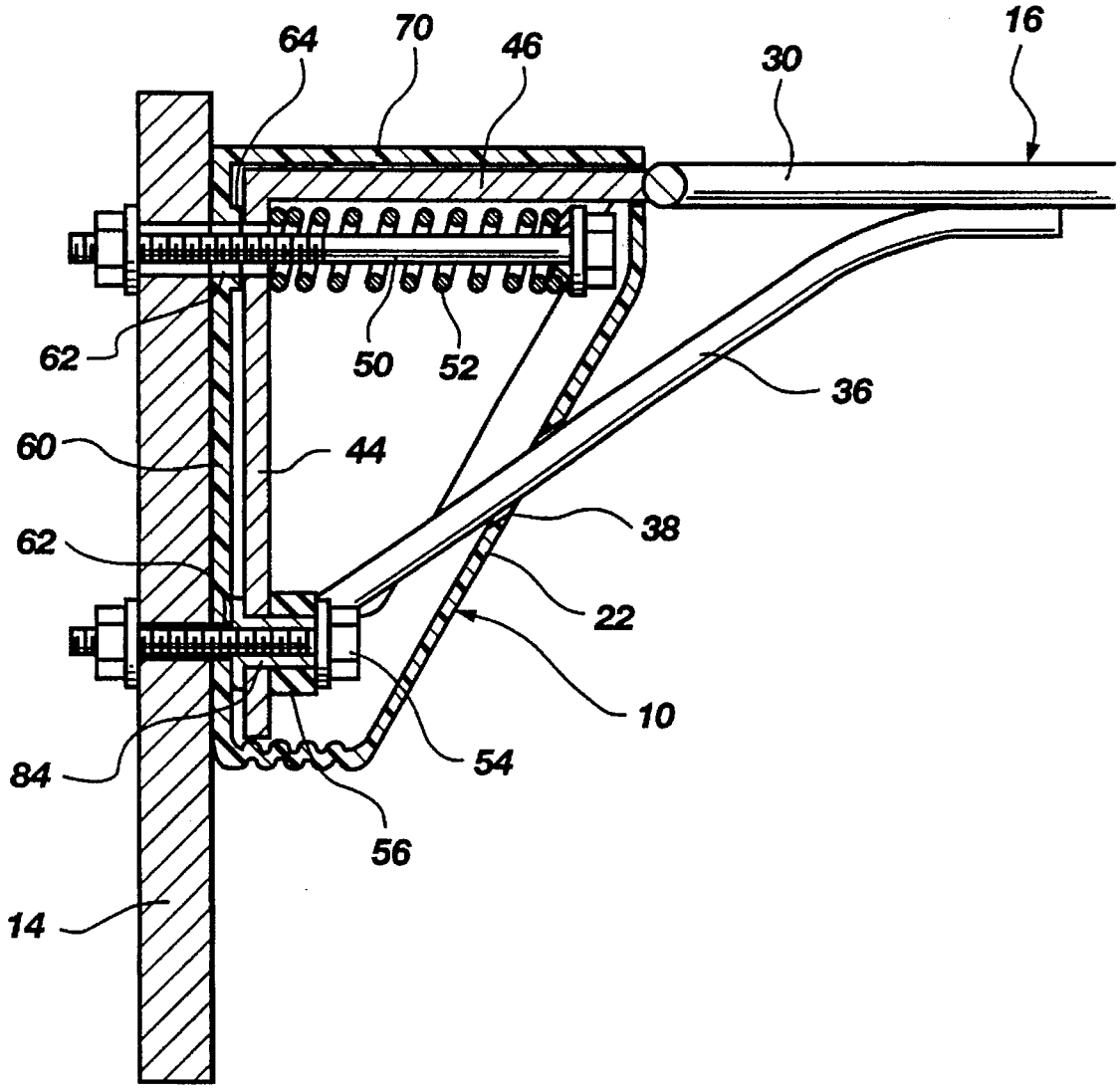
FIG. 5 is a cross sectional view of FIG. 3 showing the disposition of various components in mounting the cover to a basketball goal system.

The mounting of the cover 10 of the present invention between the goal 16 and the backboard 14 is described with greater particularity with reference to FIG. 5. The cover 10 is positioned generally between the backboard 14 and the goal 16, with the holes 62 aligned with the holes in the goal 16. The bottom bolts 54 are inserted through the bottom holes on the rim mounting plate 44 and, in this embodiment, are fit with a T-nut 84. The bolts 54 are then introduced through the corresponding holes 62 in the bottom of the cover 10 and through the backboard 14. A nut is tightly attached to each bolt 54 to secure the entire assembly together.

Similarly, upper bolts 50 are each fit with a spring 52 and inserted through the corresponding holes in the upper portion of the rim mounting plate 44. The upper bolts 50 are then introduced through the holes 62 in the upper portion of the back plate 60 of the cover and through corresponding holes in the backboard 14. Notably, the spacer 64 around the holes 62 in the upper portion of the back plate 60 compensates for the thickness of the T-nuts 84 about the lower bolts 54, thereby permitting the rim mounting plate 44 to be mounted in parallel disposition with respect to the backboard 14. A nut is then secured to each of the upper bolts 50 and tightened to secure the upper portion of the goal.

The clips 82 (FIG. 4) are then attached to the horizontal rim plate 46 of the goal 16, thereby securing the top plate 70 to the goal 16. Finally, the face plate 22 is attached by twisting it about the holes 34 to open the space in the channels 38, thereby permitting the rim braces 36 to be introduced into the holes 34.

From the foregoing, it should be appreciated that the cover of the present invention provides a novel protective shield over the goal mounting mechanism of a basketball goal system. Importantly, the cover of the present invention does not have to be removed in order to safely raise or lower the height of a conventional adjustable basketball goal system. Further, the cover may easily be retrofit onto a standard basketball goal system and is easy and inexpensive to manufacture.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A cover for use on a basketball goal system, the goal system including a basketball goal mounted to a basketball backboard by a goal mounting mechanism, the basketball goal including a rim mounting plate, a rim and rim braces, comprising:

a face plate configured with a channel for receiving the tip of a force-applying implement and further configured to extend generally over the goal mounting mechanism such that the face place provides a protective shield over the goal mounting mechanism when mounted to a goal, wherein the face plate includes a fore edge and wherein the channel is configured in the fore edge of the face plate such that the rim and the channel act in combination to form a pocket for receiving the tip of the force-applying implement;

a back plate flexibly connected to the face plate and to a top plate; and attachment means for securing the cover to the basketball goal system such that the face plate covers the front of the goal mounting mechanism when the cover is mounted to the goal, said attachment means comprising a plurality of holes configured in the back plate, the holes configured to receive bolts used in mounting the basketball goal to the basketball backboard.

2. A cover for use on a basketball goal system as defined in claim 1, wherein the face plate comprises a pair of holes positioned in the face plate through which the rim braces may extend when the cover is attached to a basketball goal.

3. A cover for use on a basketball system as defined in claim 2, wherein the face plate further comprises an access channel corresponding to each hole in the face plate, each access channel extending from its respective hole to the edge of the cover, thereby accommodating the introduction of a rim brace into the hole during installation of the cover to a basketball goal assembly.

4. A cover for use on a basketball system as defined in claim 3, wherein the attachment means comprises the pair of holes and the corresponding access channels.

5. A cover for use on a basketball system as defined in claim 1, wherein the face plate is made of a flexible material.

6. A cover for use on a basketball system as defined in claim 1, further comprising a pair of side plates attached to the top plate.

7. A cover for use on a basketball system as defined in claim 6, wherein the basketball goal includes a horizontal plate and wherein the attachment means further comprises a clip configured on each side plate for engagement with the horizontal rim plate.

8. A cover for use on a basketball goal system, the goal system including a basketball goal mounted to a basketball backboard by a goal mounting mechanism, the basketball goal including a rim mounting plate, a rim and rim braces, comprising:

a face plate configured with a channel for receiving the tip of a force-applying implement and further configured to extend generally over the goal mounting mechanism such that the face plate provides a protective shield over the goal mounting mechanism when mounted to a goal, the face plate having a pair of holes positioned in the face plate through which the rim braces may extend when the cover is attached to a basketball goal;

a back plate flexibly connected to the face plate;

a top plate flexibly connected to the back plate;

a pair of side plates connected to the top plate; and means for securing the back plate to the basketball goal system such that the face plate covers the front of the goal mounting mechanism when the cover is mounted to a goal.

9. A cover for use on a basketball goal system as defined in claim 8, wherein the face plate includes a fore edge and wherein the channel is configured in the fore edge of the face plate such that the rim and the channel act in combination to form a pocket for receiving the tip of the force-applying implement.

10. A cover for use on a basketball goal system as defined in claim 9, wherein the face plate further comprises an access channel corresponding to each hole in the face plate, each access channel extending from its respective hole to the edge of the cover, thereby accommodating the introduction of a rim brace into the hole during installation of the cover to a basketball goal assembly.

11. A cover for use in a basketball goal system as defined in claim 8, wherein the attachment means comprises the pair of holes and the corresponding access channels.

12. A cover for use in a basketball goal system as defined in claim 8, wherein the face plate is made of a flexible material.

13. A cover for use in a basketball goal system as defined in claim 12, wherein the flexible material comprises plastic.

14. A cover for use in a basketball goal system as defined in claim 13, wherein the cover is made as a unitary molded piece of plastic.

15. A cover for use in a basketball goal system as defined in claim 8, wherein the back plate is configured with holes which correspond in size and position to a standard bolt pattern of a rim mounting plate of a basketball goal.

16. A cover for use in a basketball goal system as defined in claim 8, wherein the basketball goal includes a horizontal plate and wherein the attachment means further comprises a clip configured on each side plate for engaging with the horizontal rim plate.

17. A cover for use in a basketball goal system as defined in claim 8, wherein the face plate is further configured with flanges which extend around the edges of the side plates when the cover is mounted to a goal such that the face plate and the side plates partially overlap.

18. A basketball goal system comprising:

a basketball backboard;

a basketball goal mounted to the basketball backboard, the basketball goal comprising, a rim;

a pair of rim braces;

a rim mounting plate; and a horizontal plate;

a cover, comprising;

a face plate configured with a fore edge and further configured with a notch in the fore edge of the face plate such that the rim and the notch act in combination to form a pocket for receiving the tip of a force-applying implement;

a pair of holes positioned in the face plate through which the rim braces may extend when the cover is attached to a basketball goal;

a pair of access channel corresponding to each hole in the face plate, each access channel extending from its respective hole to the edge of the cover;

a back plate flexibly connected to the face plate;

a top plate flexibly connected to the back plate;

a pair of side plates connected to the top plate; and means for securing the back plate to the basketball goal system such that the face plate covers the front of the goal mounting mechanism when the cover is mounted to the goal.

19. A cover for use in a basketball goal system as defined in claim 18, wherein the face plate is made of a flexible material.

20. A cover for use in a basketball goal system as defined in claim 19, wherein the flexible material comprises plastic.

21. A cover for use in a basketball goal system as defined in claim 20, wherein the cover is made as a unitary molded piece of plastic.

22. A cover for use in a basketball goal system as defined in claim 18, wherein the back plate is configured with holes which correspond in size and position to a standard bolt pattern of a rim mounting plate of a basketball goal.

23. A cover for use in a basketball goal system as defined in claim 18, wherein the basketball goal includes a horizontal plate wherein the attachment means further comprises a clip configured on each side plate for engagement with the horizontal rim plate.

24. A cover for use in a basketball goal system as defined in claim 18, wherein the face plate is further configured with flanges which extend around the edges of the side plates when the cover is mounted to a goal such that the face plate and the side plates partially overlap.

25. A cover for use in a basketball goal system as defined in claim 18, wherein goal mounting mechanism comprises a plurality of bolts and springs for a breakaway rim.

* * * * *